US005344737A

United States Patent [19]

Berkes et al.

[11] Patent Number: 5,344,737

[45] Date of Patent: Sep. 6, 1994

[54] POLYWAX TONER COMPOSITIONS AND PROCESSES

[75] Inventors: John S. Berkes, Webster; Bernard Grushkin, Pittsford; Thomas W. Smith, Penfield, all of N.Y.

[73] Assignee: Xerox Corporation, Stamford, Conn.

[21] Appl. No.: 22,217

[22] Filed: Feb. 25, 1993

[51] Int. Cl.[5] ..... G03G 9/08

[52] U.S. Cl. ..... 430/110; 430/904

[58] Field of Search ..... 430/137, 106, 110, 904

[56] References Cited

U.S. PATENT DOCUMENTS 3,590,000 6/1971 Patermiti et al. ..... 252/62.1
3,681,106 8/1972 Burns et al. ..... 117/17.5
4,513,074 4/1985 Nash et al. ..... 430/106.6
4,533,614 8/1985 Fukumoto et al. ..... 430/99
4,883,736 11/1989 Hoffend et al. ..... 430/110
4,919,972 4/1990 Conrad et al. ..... 427/160
5,124,224 6/1992 Berkes et al. ..... 430/110
5,240,806 8/1993 Tang et al. ..... 430/115

*Primary Examiner*—John Goodrow
*Attorney, Agent, or Firm*—E. O. Palazzo

[57] ABSTRACT

A toner composition of resin, pigment, wax, and a component of the formula $$H_3C\text{-}(CH_2)_n\text{-}(O\text{-}CH_2\text{-}CH_2)_m\text{-}OH$$

wherein n is a number of from about 30 to about 50 and m is a number of from about 3 to about 16.

24 Claims, No Drawings

POLYWAX TONER COMPOSITIONS AND PROCESSES

BACKGROUND OF THE INVENTION

The present invention is generally directed to toner compositions, and processes thereof. More specifically, the present invention is directed to toner compositions comprised of a dispersion of a wax in toner resins, such as polyesters, especially polyesters that can be selected for the preparation of heat fixable toners with, for example, excellent low temperature fixing characteristics and superior offset properties in a hot roll fixing system, and with excellent vinyl offset properties. Dispersion of waxes in, for example, toner resins like polyesters is difficult, and cannot be effectively accomplished because of the incompatibility of the wax and the polyester resulting in large wax domains. When large wax domains are present, upon micronization of the toner thereof, there is a propensity to cause the formation of toner particles containing primarily the wax, and particles composed primarily, or exclusively of the wax. The aforementioned particles with high wax content will not, for example, charge the same as the remainder of the toner components. The free wax particles can eventually collect on a donor roll or photoreceptor and cause the filming thereof. It is, therefore, advantageous that these wax particles be retained in the toner. Also, the toner pigments are not easily dispersed in the wax causing both development and fuser ghosting problems. The toner and processes of the present invention enable, for example, the effective consistent roll fusing of the resulting toners with polyester resins, and there can be selected low amounts of fuser oil, reference for example U.S. Pat. No. 5,124,224, the disclosure of which is totally incorporated herein by reference. In embodiments, the present invention is directed to a toner comprised of resin, pigment and wax, particularly a low molecular weight wax with a molecular weight of from about 1,000 to about 20,000 and ethoxylated long chain alcohols which are believed to be block copolymers with surfactant properties, and are available from Petrolite Specialties Polymers Group, Tulsa, Okla. as, for example, UNITHOX 420®, 450®, 480200 , 520®, 550®, 720® and 750®.

Toner utilized in development in the electrographic process is generally prepared by mixing and dispersing a colorant and a charge enhancing additive into a thermoplastic binder resin, followed by micropulverization. As the thermoplastic binder resin, several polymers are known including polystyrenes, styrene-acrylic resins, styrene-methacrylic resins, polyesters, epoxy resins, acrylics, urethanes and copolymers thereof. As the colorant, carbon black is utilized often, and as the charge enhancing additive, alkyl pyridinium halides, distearyl dimethyl ammonium methyl sulfate, and negative charge enhancing additives, such as zinc and aluminum salts of tertiary butyl salicylic acid, and the like, can be selected.

Toner can be fixed to a support medium, such as a sheet of paper or transparency, by different fixing methods. A fixing system which is very advantageous in heat transfer efficiency and is especially suited for high speed electrophotographic processes is hot roll fixing. In this method, the support medium carrying a toner image is transported between a heated fuser roll and a pressure roll with the image face contacting the fuser roll. Upon contact with the heated fuser roll, the toner melts and adheres to the support medium forming a fixed image.

Fixing performance of the toner can be characterized as a function of temperature. The lowest temperature at which the toner adheres to the support medium is referred to as the Cold Offset Temperature (COT), and the maximum temperature at which the toner does not adhere to the fuser roll is referred to as the Hot Offset Temperature (HOT). When the fuser temperature exceeds HOT, some of the molten toner adheres to the fuser roll during fixing and is transferred to subsequent substrates containing developed images resulting, for example, in blurred images. This undesirable phenomenon is referred to as the offsetting. Between the COT and HOT of the toner is the Minimum Fix Temperature (MFT) which is the minimum temperature at which acceptable adhesion of the toner to the support medium occurs as determined by, for example, a creasing or an abrasion test. The difference between MFT and HOT is known as the fusing latitude.

The hot roll fixing system described herein and a number of toners presently used therein exhibit several problems. First, the binder resins in the toners can require a relatively high temperature enabling fixing to a support medium. This may result in high power consumption, low fixing speeds, and reduced life of the fuser roll and fuser roll bearings. Further, offsetting can be a problem. Also, toners containing vinyl type binder resins such as styrene-acrylic resins may have an additional problem which is known as vinyl offset. Vinyl offset occurs when a sheet of paper or transparency with a fixed toner image comes in contact for a period of time with a polyvinyl chloride (PVC) surface containing a plasticizer used in making the vinyl material flexible such as, for example, in vinyl binder covers, and the fixed image adheres to the PVC surface. Toners prepared from certain polyesters generally exhibit little or no vinyl offset.

There is a need for a toner which has low fix temperature and high offset temperature (or wide fusing latitude), and superior vinyl offset property, and processes for the preparation of such a toner. Toners which operate at lower temperatures would reduce the power needed for operation and increase the life of the fuser roll and the high temperature fuser roll bearings. Additionally, such low melt toners, that is toners with a MFT lower than 200° C., and preferably lower than 160° C., would reduce the volatilization of release oil such as silicone oil which may occur during high temperature operation and which can cause problems when the volatilized oil condenses in other areas of the copying machine. In particular, toners with wide fusing latitude and with acceptable toner particle elasticity are needed. Toners with wide fusing latitude can provide flexibility in the amount of oil needed as release agent and can minimize copy quality deterioration related to the toner offsetting to the fuser roll.

To lower the minimum fix temperature of the binder resin, in some instances the molecular weight of the resin may be lowered. Low molecular weight and amorphous polyester resins and epoxy resins have been used for low temperature fixing toners. For example, polyester resins as a binder for toner are disclosed in U.S. Pat. No. 3,590,000 to Palermiti et al. and U.S. Pat. No. 3,681,106 to Burns et al. The minimum fixing temperature of polyester binder resins can be lower than that of other materials, such as styrene-acrylic and styrene-methacrylic resins. However, this may lead to a lowering of the hot offset temperature, and as a result, decreased offset resistance. In addition, the glass transition temperature of the resin may be decreased, which may cause the undesirable phenomenon of blocking of the toner during storage.

Another method of improving offset resistance is to utilize a crosslinked resin in the binder resin. For example, U.S. Pat. No. 3,941,898 to Sadamatsu et al. discloses a toner in which a crosslinked vinyl type polymer is used as the binder resin. Similar disclosures for vinyl type resins are made in U.S. Pat. Re. Nos. 31,072 (a reissue of 3,938,992) to Jadwin et al., 4,556,624 to Gruber et al., 4,604,338 to Gruber et al. and 4,824,750 to Mahalek et al.

While significant improvements can be obtained in offset resistance and entanglement resistance, a major drawback may ensue in that with crosslinked resins prepared by conventional polymerization, that is crosslinking during polymerization using a crosslinking agent, there exist three types of polymer configurations: a linear and soluble portion referred to as the linear portion, a portion comprising highly crosslinked gel particles, which is not soluble in substantially any solvent, for example tetrahydrofuran, toluene and the like, and is referred to as a gel, and a crosslinked portion, which is low in crosslinking density and, therefore, is soluble in some solvents like tetrahydrofuran, toluene and the like, and is referred to as the sol. The presence of highly crosslinked gel in the binder resin increases the hot offset temperature, but at the same time the low crosslink density portion or sol increases the minimum fix temperature. An increase in the amount of crosslinking in these types of resins results in an increase not only of the gel content, but also an increase in the amount of sol or soluble crosslinked polymer with low degree of crosslinking in the mixture. This results in an elevation of the minimum fix temperature, and as a consequence, in a reduction or reduced increase of the fusing latitude. Also, a drawback of certain crosslinked polymers prepared by conventional polymerization is that as the degree of crosslinking increases, the gel particles or very highly crosslinked insoluble polymer with high molecular weight grow larger. The large gel particles can be more difficult to disperse pigment in, causing the formation of unpigmented toner particles during pulverization, and toner developability may thus be hindered. Also, compatibility with other binder resins may be relatively poor and toners containing vinyl polymers often show vinyl offset.

Crosslinked polyester binder resins prepared by conventional polycondensation reactions have been prepared for improving offset resistance, such as disclosed, for example, in U.S. Pat. No. 3,681,106 to Burns et al. As with crosslinked vinyl resins, increased crosslinking as obtained in such conventional polycondensation reactions may cause the minimum fix temperature to increase. When crosslinking is carried out during polycondensation using tri- or polyfunctional monomers as crosslinking agents with the polycondensation monomers, the net effect is that apart from generating highly crosslinked high molecular weight gel particles, which are not soluble in substantially any solvent, the molecular weight distribution of the soluble part branches due to the formation of sol or crosslinked polymer with a very low degree of crosslinking, which is soluble in some solvents. These intermediate high molecular weight species may result in an increase in the melt viscosity of the resin at low and high temperature, which can cause the minimum fix temperature to increase. Furthermore, gel particles formed in the polycondensation reaction, which is carried out using conventional polycondensation in a reactor with low shear mixing, can grow rapidly with increase in degree of crosslinking. As in the case of crosslinked vinyl polymers using conventional polymerization reactions, these large gel particles may be more difficult to disperse pigment in resulting in unpigmented toner particles after pulverization, and thus hindering developability. Another consequence of incorporating branching components is a decrease in micronization rates from 1.2 to twice that of the linear polymer.

U.S. Pat. No. 4,533,614 to Fukumoto et al. discloses a crosslinked polyester binder resin which evidences low temperature fix and good offset resistance. Similar disclosures are presented in U.S. Pat. No. 3,681,106 and Japanese Laid-Open Patent Applications 943,62/1981, 1160,41/1981 and 166,651/1980. As discussed in the '614 patent, incorporation of metal complexes, however, can influence unfavorably the charging properties of the toner. Also, with colored toners other than black, metal complexes can adversely affect the color of pigments. It is also known that metal containing toner can have disposal problems in some geographical areas, such as for example in the state of California, U.S.A. Metal complexes are often also expensive materials.

Also, to prevent fuser roll offsetting and to increase fuser latitude of toners, the toner composition can be modified. For example, waxes, such as low molecular weight polyethylene, polypropylene, and the like, have been added to toners to increase their release properties, as disclosed in U.S. Pat. No. 4,513,074 to Nash et al., the disclosure of which is totally incorporated herein by reference. However, to prevent offset and insure the functionality of the toner the wax selected should be very well dispersed with the average volume diameter of the dispersed wax phase preferably ranging from about 0.1 micron to about 2 microns. It is known that achievement of this level of wax dispersion is difficult to accomplish in low shear compounding equipment, such as extruders and with certain functional materials like certain polyesters, or with low molecular weight resins. Another difficulty which arises is mismatch of viscosity among toner components, for example because certain polyesters suitable for roll fusing are of sufficiently high molecular weight to prevent offset their melt viscosity is significantly higher than that of the wax at the melt mixing temperature.

The problem associated with the dispersion of waxes, especially polyethylene waxes like POLYWAX®, obtained from Petrolite Corporation, in low melt viscosity polyesters can be eliminated or minimized with the toners and processes of of the present invention.

SUMMARY OF THE INVENTION

These and other objects of the present invention are accomplished in embodiments by the addition of interfacial agents to toners comprised of polyester and wax. More specifically, the present invention in embodiments is directed to a toner composition comprised of toner resin particles, pigment particles, wax, such as a low molecular weight wax like polypropylene and polyethylene available from Sanyo Corporation, for example, as VISCOL 550P TM, and a component that will enable permanent or substantially permanent dispersion of the wax in the toner and prevent the wax from migrating from the toner, which component is of the formula $$H_3C(CH_2)_n(O-CH_2-CH_2)_mOH$$

wherein n and m are numbers, and more specifically, n is a number of from about 30 to about 50 and m is a number of from about 3 to about 16. These components are available from Petrolire Specialty Polymers Group of Tulsa, Okla. as UNITHOX ®, and more specifically, UNITHOX 420 ® with a number average molecular weight of 560, an ethylene oxide content of 20 percent by weight, a hydroxyl number of 83, a melting point of 195° F., and a flash point of 475° F.; UNITHOX 450 ® with a number average molecular weight of 900, an ethylene oxide content of 50 percent by weight, a hydroxyl number of 52, a melting point of 194° F., and a flash point of 500° F.; UNITHOX 480 ® with a number average molecular weight of 2,250, an ethylene oxide content of 80 percent by weight, a hydroxyl number of 21, a melting point of 185° F., and a flash point of 500° F.; UNITHOX 520 ® with a number average molecular weight of 700, an ethylene oxide content of 20 percent by weight, a hydroxyl number of 65, a melting point of 210° F., and a flash point of 500° F.; UNITHOX 550 ® with a number average molecular weight of 1,100, an ethylene oxide content of 50 percent by weight, a hydroxyl number of 40, a melting point of 209° F., and a flash point of 510° F.; UNITHOX 720 ® with a number average molecular weight of 875, an ethylene oxide content of 20 percent by weight, a hydroxyl number of 54, a melting point of 222° F., and a flash point of 520° F.; and UNITHOX 750 ® with a number average molecular weight of 1,400, an ethylene oxide content of 50 percent by weight, a hydroxyl number of 34, a melting point of 22 ° F., and a flash point of 520° F. The aforementioned components enable the substantial retention of the wax in the toner composition, and thereby free wax and the problems associated therewith are avoided, for example in a two component development systems, such as the Xerox Corporation 5100, after 5,000 copies the magnetic cleaning brush had no film of wax thereon as compared to a film of wax thereon when the interfacial agent or UNITHOX ® component were not selected, and wherein the wax prevents a brush from effectively cleaning the photoreceptor or imaging member surface. Various effective amounts of the interfacial UNITHOX ® component can be selected such as, for example, from about 0.5 to about 4.0 and preferably from about 0.5 to 3.5 weight percent, and wherein there are generated wax domains in the toner, which wax domains remain permanently with the toner and wherein such domains have a maximum size ranging from about 1.0 micron to about 4.0 microns in average volume diameter, and wherein the wax is retained within the toner particles after the micronization process.

Although it is not desired to be limited by theory, it is believed that the interfacial agent, such as the UNITHOX ®, assists in the effective dispersion of the wax in the toner resin, especially polyester resins. Accordingly, in embodiments the presence of the interfacial component will result in wax particles whose domains are smaller by a factor, for example, of 2 to 10 in size than compositions prepared without such an interfacial component.

It is believed that the UNITHOX ® are ethoxylated alcohols and can be considered nonionic surfactants derived, for example, from primary alcohols with carbon chain lengths of 30, 40, 50 and the like. Accordingly, these components can be considered diblock copolymers wherein one segment has an infinity for and is compatible and miscible with the wax selected for the toner, and the other part has an infinity for and is compatible and miscible with the resin such as the polyester selected for the toner.

It addition, there can be utilized, it is believed, as a replacement for the UNITHOX ® or in addition to the UNITHOX ® other similar effective wax dispersants and/or compatibilizers that retain the wax in the toner, which components include block copolymers of polyethylene or polypropylene with propylene oxide, acrylic acid, caprolactone, caprolactam, alkyloxazolines, or vinyl chloride; polyethylene block polyesters; polyethylene block polyvinyl chlorides; polyethylene block polyvinylidene fluorides and the like. The block copolymers can be prepared from their corresponding monomers by the coupling of preformed polymers, by initiation of the ring opening of the corresponding cyclic monomers by end-functionalized polyolefins or long chain alcohols, or living anionic polymerization techniques.

In embodiments, the toners of the present invention are comprised of low melting polyester resins, for example with a melting temperature of from about 110° to about 150° C., UNITHOX ® pigment, optional additives, such as known charge additives and know surface additives, and which toners have low molecular weight waxes substantially permanently dispersed therein and wherein free wax is avoided, especially subsequent to micronization when the toner is prepared. In embodiments, there is provided with the toner compositions and process of the present invention small wax domains and retention of the wax in the toner, especially after toner processing and subsequent to micronization.

Examples of resin polyesters selected for the present invention are as indicated herein and include polyesters prepared by the condensation of propyloxylated bisphenol A with fumaric acid, polyesters prepared by condensation of terephthalic acid, phthalic acid, trimetallic acid, fumaric acid or their methyl esters, and diols such as ethylene glycol; 1,2- and 1,3-propane diol, and 1,3- and 1,4-butane diol, mixtures of diols of the above acids or acid esters and alcohols yielding polyesters with a glass transition temperature of from about 40° C. to about 90° C. and preferably from about 50° C. to about 68° C.

Other similar polyesters can be selected including those available as the SPAR ® series and those as illustrated, for example, in U.S. Pat. No.3,590,000, the disclosure of which is totally incorporated herein by reference.

Waxes that can be included in the toner binder resin, during formulation thereof, including, for example, during crosslinking or in a subsequent step, are crystalline polyethylene (POLYWAX 700 ®, 1000 ®, 2000 ®, 3000 ® which can be obtained from Petrolite), crystalline polypropylene waxes (660P TM and 550P TM which can be obtained from Sanyo Corporation) and polyethylene-polypropylene copolymers (Petrolite CP-7 TM, CP-11½ or CP-12 TM). The waxes can be added to the binder resin in any effective amount such as, for example, from about 1 to about 8 percent by weight. These and other waxes are, as indicated herein, substantially permanently dispersed in the toner by adding to the toner the interfacial components such as the UNITHOX ® components.

The low melt toners and toner resins may be prepared in embodiments by a number of known methods such as by a reactive melt mixing process wherein reactive toner resins like polyester resins and wax may be fabricated by a reactive melt mixing process comprising the steps of: (1) melting a reactive base resin, thereby forming a polymer melt, in a melt mixing device; (2) optionally initiating crosslinking of the polymer melt, preferably with a chemical crosslinking initiator and increased reaction temperature; (3) optionally retaining the polymer melt in the melt mixing device for a sufficient residence time that partial crosslinking of the base resin may be achieved; (4) providing sufficiently high shear while adding the wax during the crosslinking reaction to keep the gel particles formed during crosslinking small in size and well distributed in the polymer melt; and (5) optionally devolatilizing the polymer melt to remove any effluent volatiles. The high temperature reactive melt mixing process allows for very rapid crosslinking which enables the formulation of substantially only microgel particles, and the high shear of the process prevents undue growth of the microgels and enables the microgel particles to be uniformly distributed in the resin.

The binder resin and dispersed wax are generally present in the toner in an amount of from about 40 to about 98 percent by weight, and more preferably in an amount of from about 50 to about 98 percent by weight. For example, binder resins can be subsequently melt blended or otherwise mixed with a colorant, charge carrier control additives, surfactants, emulsifiers, pigment dispersants, flow additives, and the like. The resultant product can then be pulverized by known methods, such as Fitzmilling, and further attrited by air or mechanical grinding methods to form toner particles. The toner particles preferably have a volume average particle diameter of about 5 to about 25 micrometers, or more preferably from about 5 to about 15 micrometers as measured by a Coulter Counter.

Various suitable colorants can be selected, including colored pigments, dyes, and mixtures thereof including carbon black, such as REGAL 330® carbon black (Cabot), Acetylene Black, Lamp Black, Aniline Black, Chrome Yellow, Zinc Yellow, Sicofast Yellow, Luna Yellow, Novaperm Yellow, Chrome Orange, Bayplast Orange, Cadmium Red, LITHOL SCARLET TM, HOSTAPERM RED TM, FANAL PINK TM, HOSTAPERM PINK TM, LITHOL RED TM, Rhodamine Lake B, Brilliant Carmine, Heliogen Blue, HOSTAPERM BLUE TM, Neopan Blue, PV FAST BLUE TM, Cinquassi Green, HOSTAPERM GREEN TM, titanium dioxide, cobalt, nickel, iron powder, SICOPUR 4068 FF TM, and iron oxides such as MAPICO BLACK® (Columbian Chemicals), NP608 TM and NP604 TM (Northern Pigment), BAYFERROX 8610 TM (Bayer), MO8699 TM (Mobay), TMB-100 TM (Magnox), mixtures thereof, and the like.

The colorant, preferably carbon black, cyan, magenta and/or yellow colorant, is incorporated in the toner in an amount sufficient to impart the desired color to the toner. In general, pigment or dye is employed in an amount ranging from about 2 to about 60 percent by weight, and preferably from about 2 to about 7 percent by weight for color toner and preferably from about 5 to about 60 percent by weight for black toner.

Various known suitable effective positive or negative charge enhancing additives can be selected for incorporation into the toner compositions of the present invention, preferably in an amount of about 0.1 to about 10, and more preferably from about 1 to about 3 percent by weight. Examples include quaternary ammonium compounds inclusive of alkyl pyridinium halides; alkyl pyridinium compounds, reference U.S. Pat. No. 4,298,672, the disclosure of which is totally incorporated herein by reference; organic sulfate and sulfonate compositions, U.S. Pat. No. 4,338,390, the disclosure of which is totally incorporated herein by reference; cetyl pyridinium tetrafluoroborates; distearyl dimethyl ammonium methyl sulfate; aluminum salts such as BONTRON E84 TM or E88 TM (Hodogaya Chemical); U.S. Pat. No. 4,853,003, the disclosure of which is totally incorporated herein by reference, and the like.

Additionally, external additives may be added to control charging characteristics, impede toner blocking, and to improve flow, cleanability, transfer such as metal salts of fatty acids, like zinc stearate, colloidal silicas, like AEROSILS®, metal oxides, like aluminum oxide, tin oxide, titanium oxide, and mixtures thereof, and the like. These additives are present in various effective amounts such as, for example, from about 0.1 to about 3 weight percent.

The resulting toner particles optionally can be formulated into a developer composition by mixing with carrier particles. Illustrative examples of carrier particles that can be selected for mixing with the toner composition prepared in accordance with the present invention include those particles that are capable of triboelectrically obtaining a charge of opposite polarity to that of the toner particles. Accordingly, in one embodiment the carrier particles may be selected so as to be of a negative polarity in order that the toner particles which are positively charged will adhere to and surround the carrier particles. Illustrative examples of such carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, the entire disclosure of which is hereby totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby totally incorporated herein by reference.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluorethylenes, other known coatings, and the like.

The diameter of the carrier particles is generally from about 40 microns to about 1,000 microns, preferably from about 50 to 200 microns, thus allowing these particles to possess sufficient density and inertia to avoid adherence to the electrostatic images during the development process. The carrier particles can be mixed with the toner particles in various suitable combinations. However, in embodiments about 1 part carrier to about 10 parts toner are mixed with from about 100 to about 200 of carrier.

Toners of the present invention can be used in known electrostatographic imaging and printing methods, although the fusing energy requirements of some of those methods can be reduced in view of the advantageous fusing properties of the toner of the invention as indicated herein. Thus, for example, the toners or developers of the invention can be charged, triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll at a temperature lower than 200° C., preferably lower than 160° C., more preferably lower than 140° C., and more preferably about 110° C. Also, with the POLYWAX® and UNITHOX® improved fusing latitude can be achieved as illustrated herein.

The toners and developers of the present invention are useful in a number of imaging and printing systems, particularly xerographic imaging and printing systems, including single component systems such as those utilized in the Xerox Corporation 4030 machine, conductive mag brush, dual component development systems such as the Xerox Corporation 5100, and the like.

The invention will further be illustrated in the following, nonlimiting Examples, it being understood that these Examples are intended to be illustrative only and that the invention is not intended to be limited to the materials, conditions, process parameters and the like recited herein. Parts and percentages are by weight unless otherwise indicated.

COMPARATIVE EXAMPLE 1

There was prepared by extrusion a toner composition comprised of 4 parts of POLYWAX 1000®, 2 parts of PV FAST BLUE TM and 94 parts of SPAR II® polyester resin. The components were thoroughly mixed then added to a Werner Pfleiderer ZSK-28 extruder at the rate of 6 pounds/hour. The exit melt temperature of the extrudate was 183° F. The screw RPM was 240. After cooling, the extrudate was crushed in a Fitzmill and micronized to yield 1 to 30 μm toner particles in a Sturtevant air attritor. The Fitzmilled particles were sectioned and examined by transmission electron microscopy (TEM) and were found to contain wax domains with a maximum diameter of about 8 μm. The micronized toner particles were examined by polarized optical microscopy and found to contain numerous particles of free crystalline wax.

The free crystalline wax, which is not permanently contained in the toner compositions, has a number of disadvantages as indicated herein including the formation of a film of wax on the photoreceptor imaging member, reference U.S. Pat. No. 4,265,990, the disclosure of which is totally incorporated herein by reference, and this prevents a brush, for example, from effectively cleaning the photoreceptor surface causing developed images with low resolution and which images are not smudge resistant, for example, it is believed. These disadvantages are avoided or minimized with the toner and process of the present invention.

EXAMPLE I

There was prepared by extrusion a toner composition comprised of 4 parts of POLYWAX 1000®, 0.5 part of UNITHOX 550® (a Petrolite Company commercially available block copolymer of ethylene and ethylene oxide), 2 parts of PV FAST BLUE TM and 93.5 parts of SPAR II® polyester resin. The components were thoroughly mixed as in Comparative Example 1 and processed in an analogous manner to yield Fitzmilled particles and micronized toner. The Fitzmilled particles were sectioned and examined by transmission electron microscopy (TEM) and were found to have wax domains of a size maximum of 1 to 4 μm. The micronized toner particles were examined by polarized optical microscopy, and in contrast to Comparative Example 1 free wax particles were not observed. More specifically, substantially no free wax was observed and in reference to Comparative Example 1, about 75 to about 90 percent less free wax was observed in embodiments. Also, it is believed that since the wax is substantially retained in the toner no film of wax will form on a magnetic cleaning brush and, therefore, the brush can be utilized to effectively clean the photoreceptor imaging member for extended periods of time, including after 5,000 imaging cycles in the Xerox Corporation 5100.

EXAMPLES II to VII

Additional toner compositions with increasing amounts of UNITHOX 550® up to 3.5 parts were prepared as in Example I. Table I indicates, for example, that the size of the dispersed wax particles decreases monotonically with increasing block copolymer concentration and that free wax particles were generally absent from their micronized toners except for Comparative Example 1.

TABLE I

The Effect of UNITHOX 550 ® Concentration on Polywax Particle Size

| Toner Composition | Wt. % UNITHOX 550 ® | Maximum Size of Dispersed POLYWAX ® Particles |
|---|---|---|
| Comparative Example 1[a] | 0 | 8.0 μm |
| Example I[b] | 0.5 | 4.0 μm |
| Example II[b] | 1.0 | 3.0 μm |
| Example III[b] | 1.5 | 3.0 μm |
| Example IV[b] | 2.0 | 2.5 μm |
| Example V[b] | 2.5 | 2.5 μm |
| Example VI[b] | 3.0 | 1.5 μm |
| Example VII[b] | 3.5 | 1.0 μm |

[a]Free wax observed in optical micrographs of micronized toner.
[b]Free wax not readily observed in optical micrographs of micronized toner Other block copolymers of ethylene and ethylene oxide are effective in dispersing waxes in polyester toner resins. In Examples VIII through X, UNITHOX 450® was employed in place of UNITHOX 550®.

EXAMPLE VIII TO X

Toner compositions with UNITHOX 450® in the range of 0.5 to 2.0 weight percent were prepared as in Example I. Table II shows the size of the dispersed wax particles in these compositions. Again, the size of the disperse wax particles were reduced over that of Comparative Example 1 and free wax particles were generally absent from these micronized toners except for comparative Example 1.

TABLE II

The Effect of UNITHOX 450 ® Concentration on POLYWAX ® Particle Size

| Toner Composition | Wt. % UNITHOX 450 ® | Maximum Size of Dispersed POLYWAX ® Particles |
|---|---|---|
| Exaple VIII | 0.5 | 3.0 μm |
| Example IX | 1.0 | 2.0 μm |
| Example X | 2.0 | 1.0 μm |

While the invention has been described with reference to particular preferred embodiments, the invention is not limited to the specific examples given, and other embodiments and modifications can be made by those skilled in the art without departing from the spirit and scope of the invention.

What is claimed is:

1. A toner composition of resin, pigment, wax, and a component of the formula $$H_3C\text{-}(CH_2)_n\text{-}(O\text{-}CH_2\text{-}CH_2)_m\text{-}OH$$

wherein n is a number of from about 30 to about 50 and m is a number of from about 3 to about 16.

2. A toner in accordance with claim 1 wherein the resin particles are comprised of a polyester.

3. A toner in accordance with claim 1 wherein the wax has a molecular weight of from about 1,000 to about 20,000.

4. A toner in accordance with claim 1 wherein the wax has a molecular weight of from about 1,000 to about 7,000.

5. A toner in accordance with claim 1 wherein the wax is polyethylene or polypropylene.

6. A toner in accordance with claim 1 wherein the number average molecular weight of said component of the formula illustrated is from about 500 to about 2,500.

7. A toner in accordance with claim 1 wherein the pigment is carbon black, cyan, magenta, yellow, red, blue, green or mixtures thereof.

8. A process for the preparation of a resin composite which comprises the addition of a wax and an ethoxylated component to a toner resin, and wherein there results a microdispersion of said wax in the resin without solubilizing said wax, and wherein the ethoxylated component has the following formula $$H_3C\text{-}(CH_2)_n\text{-}(O\text{-}CH_2\text{-}CH_2)_m\text{-}OH$$

wherein n is a number of from about 30 to about 50 and m is a number of from about 3 to about 16.

9. A process in accordance with claim 8 wherein said ethoxylated alcohol contains from about 20 to about 30 carbon atoms.

10. A process in accordance with claim 8 wherein said ethoxylated alcohol is present in an amount of from 0.1 to 5 percent by weight.

11. A process in accordance with claim 8 wherein there is added to the formed resin product pigment and charge additive thereby resulting in a toner composition.

12. A process in accordance with claim 8 wherein there is added to the formed resin product pigment, charge additive and surface additives, thereby resulting in a toner composition.

13. A process in accordance with claim 8 wherein said wax is crystalline with a density of from about 0.93 to about 0.98.

14. A process in accordance with claim 8 wherein said wax is present in an amount of from about 0.1 to about 20 weight percent.

15. A process in accordance with claim 8 wherein the toner resin is a linear polyester and has a molecular weight ranging from about 5,000 to about 30,000 Daltons.

16. A process in accordance with claim 8 wherein the resin is comprised of a crosslinked polyester.

17. A process in accordance with claim 16 wherein the polyester contains from about 0 to about 30 percent by weight of gel.

18. A toner in accordance with claim 1 wherein the wax is permanently dispersed in the resin subsequent to formulating a toner composition with said resin and subsequent to micronization of said toner.

19. A process for retaining a wax in a toner composition which comprises adding to said toner composition a component of the formula $$H_3C\text{-}(CH_2)_n\text{-}(O\text{-}CH_2\text{-}CH_2)_m\text{-}OH$$

wherein n is a number of from about 30 to about 50 and m is a number of from about 3 to about 16, and wherein said wax is retained subsequent to micronization of said toner.

20. A toner composition comprised of resin, pigment, substantially permanently retained wax component, and a component of the formula $$H_3C\text{-}(CH_2)_n\text{-}(O\text{-}CH_2\text{-}CH_2)_m\text{-}OH$$

wherein n and m represent the number of repeating segments.

21. A toner composition in accordance with claim 1 wherein said component is an interfacial agent present in an amount of from about 0.5 to about 4 weight percent.

22. A toner in accordance with claim 1 wherein said component enables improved dispersion of the wax in said toner.

23. A toner in accordance with claim 1 wherein said wax is substantially retained in said toner and essentially no free wax is present subsequent to the use of said toner in electrophotographic imaging apparatus, and wherein large domains of wax are present upon micronization of the toner thereof.

24. A toner composition consisting essentially of resin, pigment, wax, and a component of the formula $$H_3C\text{-}(CH_2)_n(O\text{-}CH_2\text{-}CH_2\text{-})_mOH$$

wherein n is a number of from about 30 to about 50, and m is a number of from about 3 to about 16.

* * * * *